US010316425B2

(12) United States Patent
Yajima et al.

(10) Patent No.: US 10,316,425 B2
(45) Date of Patent: Jun. 11, 2019

(54) SUBSTRATE HOLDER, PLATING APPARATUS, AND PLATING METHOD

(71) Applicant: EBARA CORPORATION, Tokyo (JP)

(72) Inventors: Toshikazu Yajima, Tokyo (JP); Mitsutoshi Yahagi, Tokyo (JP); Masaaki Kimura, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 318 days.

(21) Appl. No.: 14/634,647

(22) Filed: Feb. 27, 2015

(65) Prior Publication Data

US 2015/0247253 A1 Sep. 3, 2015

Related U.S. Application Data

(60) Provisional application No. 61/946,630, filed on Feb. 28, 2014.

(51) Int. Cl.
*C25D 17/00* (2006.01)
*C25D 17/06* (2006.01)

(52) U.S. Cl.
CPC ..... *C25D 17/06* (2013.01); *C25D 17/001* (2013.01); *C25D 17/005* (2013.01)

(58) Field of Classification Search
CPC ..... C25D 17/001; C25D 17/005; C25D 17/06
See application file for complete search history.

(56) References Cited

U.S. PATENT DOCUMENTS 6,139,712 A * 10/2000 Patton ..... C25D 7/12 205/137
6,309,524 B1 * 10/2001 Woodruff ..... H01L 21/2885 204/297.09
2003/0019744 A1 1/2003 Pokorny
2005/0014368 A1 * 1/2005 Yoshioka ..... C25D 17/06 438/689

FOREIGN PATENT DOCUMENTS

JP H05-222590 A 8/1993
JP 2003-518333 A 6/2003
JP 2006-016651 A 1/2006
JP 2006016651 A * 1/2006

* cited by examiner

*Primary Examiner* — Louis J Rufo
(74) *Attorney, Agent, or Firm* — Baker & Hostetler LLP

(57) ABSTRACT

A substrate holder according to the present invention comprises a first power supply member and a second power supply member which allow power to be supplied to substrates having different properties. The first power supply member comprises a first power supply member end part which extends toward the inside of a substrate holding surface and is disposed at a first position of the substrate holding surface. The second power supply member comprises a second power supply member end part which extends toward the inside of the substrate holding surface and is disposed at a second position of the substrate holding surface. The first position is located on the center side of the substrate holding surface relative to the second position.

9 Claims, 13 Drawing Sheets

SUBSTRATE HOLDER, PLATING APPARATUS, AND PLATING METHOD

This application claims the priority and benefit of U.S. Provisional Patent Application No. 61/946,630 filed Feb. 28, 2014, the entire content of which is incorporated herein by reference.

TECHNICAL FIELD

The present invention relates to a substrate holder used in a plating apparatus which performs a plating process, for example, on a substrate, a plating apparatus having the substrate holder, and a plating method, and particularly relates to a substrate holder which allows power to be supplied to a plurality of types of substrates, a plating apparatus having the substrate holder, and a plating method.

BACKGROUND ART

It is conventional practice to form a wiring line in a fine wiring groove, a hole, or a resist opening provided in the surface of a semiconductor wafer etc., or to form a bump (protruding electrode), which is electrically connected with a package electrode etc., on the surface of a semiconductor wafer etc. Known methods for forming such wiring lines and bumps include, for example, an electroplating method, a vapor deposition method, a printing method, and a ball bump method. Due to increase in the number of I/Os and the reduction in pitch of semiconductor chips in the recent years, the electroplating method which allows for miniaturization and relatively stable performance has been widely used.

A plating apparatus used for the electroplating method is equipped with a substrate holder which holds a substrate such as a semiconductor wafer with an edge surface and the back surface of the substrate being sealed and the surface (surface to be plated) being exposed. When a plating process of the substrate surface is performed in this plating apparatus, the substrate holder holding the substrate is immersed in a plating solution.

Here, when a plating process is performed on the substrate held by the substrate holder, the substrate needs to be electrically connected with the negative voltage side of a power source to apply a negative voltage to the substrate surface. For this purpose, the substrate holder is provided with an electrical contact for electrically connecting an external wiring line extending from the power source and the substrate with each other. The electrical contact is configured to contact with a seed layer (conductive layer) formed on the surface of the substrate to thereby apply a negative voltage to the substrate.

Here, depending on the type of substrate, the substrate to be plated can vary in contact position of the electrical contact. For example, in the case of a substrate for forming a bump or a redistribution layer in which a resist pattern is formed on the surface to be plated, it is necessary to bring the electrical contact into contact with the outer peripheral end of the substrate where no resist pattern is formed. Due to the requirement for producing many chips from one substrate, it has become common to bring the electrical contact and the seal into contact with the substrate further on the outer side. On the other hand, a substrate with a TSV (Through Silicon Via) formed in it is composed of a support substrate and an active wafer bonded to the support substrate, and the surface of the active wafer is the surface to be plated. It is therefore necessary that the electrical contact comes into contact with the active wafer. The diameter of this active wafer is smaller than the diameter of the support substrate. Accordingly, the contact position of the electrical contact on the active wafer surface should be located further on the inside in the radial direction than the contact position of the electrical contact on the substrate for forming a bump or a rewiring line.

In order to form a plating film of a constant thickness on a substrate, it is necessary to reliably bring the electrical contact into contact with the seed layer and apply a plating current. For this purpose, a substrate holder provided with an electrical contact for exclusive use with each different type of substrate is designed and loaded on a plating apparatus.

CITATION LIST

Patent Literature

[Patent Literature 1] Japanese Patent Laid-Open No. 5-222590

However, when a plating process of a plurality of types of substrates is performed by using one plating apparatus, it is necessary to load a plurality of types of substrate holders corresponding to the types of substrates in order to achieve a desired throughput. This causes an increase in the number of the substrate holders, so that the occupation area of a stocker for storing the substrate holders inside the plating apparatus increases, which unfortunately results in an increase in installation area of the plating apparatus. Another problem is that due to the necessity of automatically or manually selecting a substrate holder to be used according to the type of substrate, the operation and manipulation of the apparatus is complicated.

The present invention has been devised in view of the above-described problems, and one object of the present invention is to provide a substrate holder which allows power to be supplied to a plurality of types of substrates, a plating apparatus equipped with the substrate holder, and a plating method.

SUMMARY

A substrate holder according to one form of the present invention is a substrate holder for holding a substrate, and includes a substrate holding surface for holding the substrate and a first power supply member and a second power supply member which allow power to be supplied to substrates having different properties, wherein: the first power supply member has a first power supply member end part which extends toward the inside of the substrate holding surface and is disposed at a first position of the substrate holding surface; the second power supply member has a second power supply member end part which extends toward the inside of the substrate holding surface and is disposed at a second position of the substrate holding surface; and the first position is located on the center side of the substrate holding surface relative to the second position.

According to the present invention, it is possible to provide a substrate holder which allows power to be supplied to a plurality of types of substrates and a plating apparatus equipped with this substrate holder.

DESCRIPTION OF EMBODIMENTS

Figure 1:
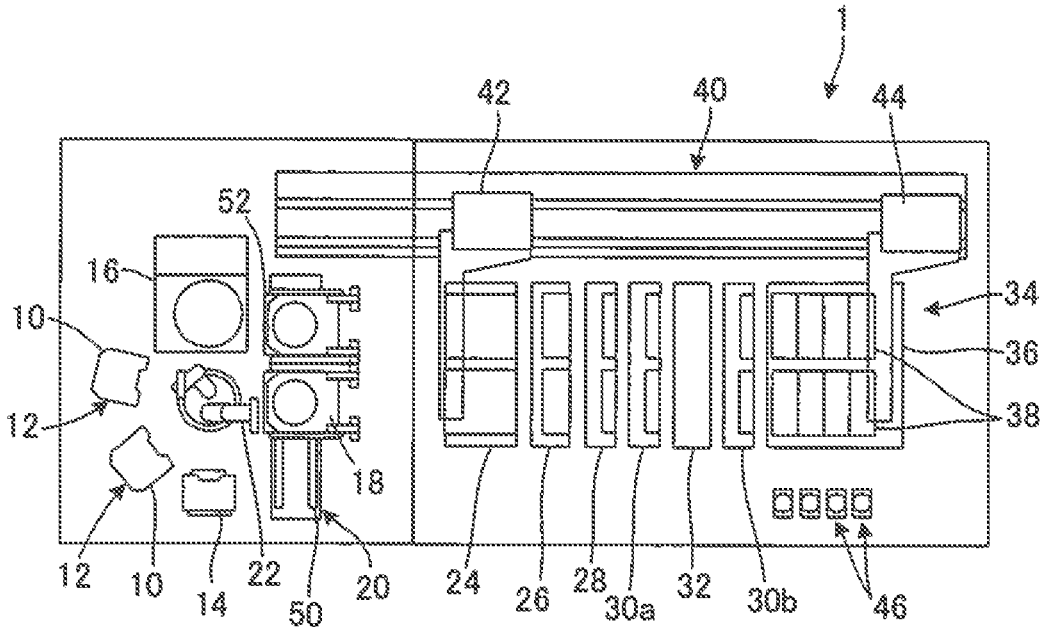
FIG. 1 is an overall arrangement plan of a plating apparatus equipped with a substrate holder according to one embodiment.

According to a first form of an embodiment of the present invention, a substrate holder for holding a substrate is provided. This substrate holder comprises a substrate holding surface for holding the substrate and a first power supply member and a second power supply member configured to allow power to be supplied to substrates having different properties. The first power supply member comprises a first power supply member end part which extends toward the inside of the substrate holding surface and is disposed at a first position of the substrate holding surface, while the second power supply member comprises a second power supply member end part which extends toward the inside of the substrate holding surface and is disposed at a second position of the substrate holding surface, and the first position is located on the center side of the substrate holding surface relative to the second position.

According to the first form, since the position at which the first power supply member end part is disposed is located further on the center side of the substrate holding surface than the position at which the second power supply member end part is disposed, it is possible to supply power to substrates having different properties (a plurality of types of substrates). As there is no need to prepare a plurality of types of substrate holders corresponding to substrates having different properties, it is possible to avoid an increase in occupation area of the stocker for storing the substrate holders in the plating apparatus. Moreover, as there is no need to prepare a plurality of types of substrate holders, it is possible to prevent complication of the process control due to handling of a plurality of types of substrate holders.

According to a second form of this embodiment, in the substrate holder of the first form, the first power supply member is configured to be separable from the second power supply member.

According to the second form, when either the first power supply member end part or the second power supply member end part has worn, only the one that has worn can be replaced. Therefore, the cost can be reduced compared with the case where the first power supply member end part and the second power supply member end part are configured integrally and need to be replaced integrally.

According to a third form of the embodiment, in the substrate holder of the first form, at least one first power supply member end part and at least one second power supply member end part are disposed adjacent to each other alternately along the circumferential direction of the substrate.

According to the third form, it is possible to prevent the first power supply member end part or the second power supply member end part from unevenly coming into contact with the substrate, and to uniformize the distribution of current flowing through the substrate. Therefore, when a substrate is plated using the substrate holder of the third form, it is possible to make the thickness and the quality of the film formed on the substrate more uniform.

According to a fourth form of the embodiment, in the substrate holder of the first form, the first power supply member end part and/or the second power supply member end part comprises a protruding portion which comes into contact with the substrate.

According to the fourth form, it is possible to supply power stably to the substrate as the protruding portion comes into contact with a predetermined part of the substrate.

According to a fifth form of the embodiment, a substrate holder for holding a substrate is provided. This substrate holder comprises a power supply member configured to contact with the substrate, and the power supply member comprises a first power supply member end part configured to contact with the substrate at a first position and a second power supply member end part configured to contact with the substrate at a second position further outside in the radial direction than the first position of the substrate, and the first power supply member end part is configured to be separable from the second power supply member end part.

According to the fifth form, the first power supply member end part is configured to contact with the substrate at the first position, while the second power supply member end part is configured to contact with the substrate at the second position. Thus, either the first power supply member end part or the second power supply member end part comes into contact with substrates having different properties (a plurality of types of substrates) and allows power to be supplied to the substrates. As a result, there is no need to prepare a plurality of types of substrate holders corresponding to substrates having different properties, and it is possible to avoid an increase in occupation area of the stocker for storing the substrate holders inside the plating apparatus. Moreover, as there is no need to prepare a plurality of types of substrate holders, it is possible to prevent complication of the process control due to handling of a plurality of types of substrate holders. In addition, according to the fifth form, when either the first power supply member end part or the second power supply member end part has worn, only the one that has worn can be replaced. Therefore, the cost can be reduced compared with the case where the first power supply member end part and the second power supply member end part are configured integrally and need to be replaced integrally.

According to a sixth form of the embodiment, a plating apparatus is provided. This plating apparatus comprises the substrate holder of the first form.

According to a seventh form of the embodiment, a plating method is provided which includes: disposing a substrate holder, which holds a first substrate or a second substrate having properties different from those of the first substrate, and an anode to face each other in a plating solution; and applying a voltage to the first substrate or the second substrate and the anode. In this plating method, the substrate holder comprises a power supply member configured to contact with the first substrate and the second substrate, and the power supply member comprises a first power supply member end part configured to contact with a front plane surface portion of the first substrate and a second power supply member end part configured to contact with a front bevel portion or a front shoulder portion of the second substrate.

According to the seventh form, the first power supply member end part can come into contact with the front plane surface portion of the first substrate, while the second power supply member end part can come into contact with the front bevel portion or the front shoulder portion of the second substrate. Thus, at least either the first power supply member end part or the second power supply member end part comes into contact with substrates having different properties (a plurality of types of substrates) and allows power to be supplied to the substrates for plating. As a result, there is no need to prepare a plurality of types of substrate holders corresponding to substrates having different properties, and it is possible to avoid an increase in occupation area of the stocker for storing the substrate holders inside the plating apparatus. Moreover, as there is no need to prepare a plurality of types of substrate holders, it is possible to prevent complication of the operation of the device due to handling of a plurality of types of substrate holders.

According to an eighth form of the embodiment, in the plating method of the seventh form, the first substrate is a bonded substrate and the second substrate is a substrate for forming a bump or a rewiring line.

According to the eighth form, the first power supply member end part comes into contact with the front plane surface portion of the bonded substrate, and the second power supply member end part comes into contact with the front bevel portion or the front shoulder portion of the substrate for forming a bump or a rewiring line. Thus, the substrate holder of this form allows power to be supplied to the substrates having different properties, namely, the bonded substrate and the substrate for forming a bump or a rewiring line, for plating.

According to a ninth form of the embodiment, in the plating method of the seventh form, the first substrate is a bonded substrate and the second substrate is a substrate with a resist having an opening formed on the surface.

According to the ninth form, the first power supply member end part comes into contact with the front plane surface portion of the bonded substrate, and the second power supply member end part comes into contact with the front bevel portion or the front shoulder portion of the substrate with the resist having the opening formed on the surface. Thus, the substrate holder of this form allows power to be supplied to the substrates having different properties, namely, the bonded substrate and the substrate with a bump or a resist having an opening formed on the surface, for plating.

According to a tenth form of the embodiment, in the plating method of the seventh form, the second power supply member end part is configured to contact with the front plane surface portion of the first substrate.

According to the tenth form, the second power supply member end part can also come into contact with the front plane surface portion of the first substrate. Therefore, when the first substrate is held by this substrate holder, the first power supply member end part and the second power supply member end part come into contact with the front plane surface portion of the first substrate. Thus, as the number of contacts for supplying power to the first substrate increases, the current supply to the substrate becomes uniform and the in-plane uniformity of the film can be improved.

According to an eleventh form of the embodiment, in the plating method of the seventh form, at least one first power supply member end part and at least one second power supply member end part are disposed adjacent to each other alternately along the circumferential direction of the first substrate or the second substrate.

According to the eleventh form, it is possible to prevent the first power supply member end part or the second power supply member end part from unevenly coming into contact with the substrate, and to uniformize the distribution of current flowing through the substrate. Thus, when a substrate is plated by the plating method of the eleventh form, it is possible to make the thickness and the quality of the film formed on the substrate more uniform.

According to a twelfth form of the embodiment, in the plating method of the seventh form, the first power supply member end part is configured to be separable from the second power supply member end part.

According to the twelfth form, when either the first power supply member end part or the second power supply member end part has worn, only the one that has worn can be replaced. Therefore, the cost can be reduced compared with the case where the first power supply member end part and the second power supply member end part are configured integrally and need to be replaced integrally.

According to a thirteenth form of the embodiment, in the plating method of the seventh form, the first power supply member end part and/or the second power supply member end part comprises a protruding portion which comes into contact with the substrate.

According to the thirteenth form, it is possible to supply power stably to the substrate as the protruding portion comes into contact with a predetermined part of the substrate.

In the following, more detailed embodiments will be described with reference to the drawings. In the drawings to be described below, the same or equivalent components will be denoted by the same reference signs and a repeated description thereof will be omitted.

FIG. 1 is an overall arrangement plan of a plating apparatus equipped with a substrate holder according to one embodiment. As shown in FIG. 1, this plating apparatus 1 is equipped with two cassette tables 12 on which cassettes 10 storing substrates such as semiconductor wafers are loaded, an aligner 14 which orients the positions of an orientation flat, a notch, etc. of a substrate to a predetermined direction, a substrate mounting/dismounting part 20 which mounts or dismounts a substrate on/from a substrate holder 18 loaded on the a substrate mounting/dismounting part 20, and a spin dryer 16 which dries plated substrates through high-speed rotation. At roughly the center of these units, a substrate carrier device 22 which is, for example, a carrier robot for carrying a substrate among these units is disposed.

The substrate mounting/dismounting part 20 includes a flat loading plate 52 which can be slid in the horizontal direction along rails 50. In a state where two substrate holders 18 are loaded horizontally side by side on the loading plate 52, the substrate carrier device 22 delivers or receives a substrate to or from one of the substrate holders 18. Thereafter, the substrate carrier device 22 slides the loading plate 52 in the horizontal direction and delivers or receives a substrate to or from the other substrate holder 18.

In the plating apparatus 1, there are further disposed a stocker 24 for storing and temporarily placing the substrate holders 18, a pre-wet tank 26 for immersing the substrate in pure water, a pre-soak tank 28 for removing by etching an oxide film from the surface of the seed layer formed on the surface of the substrate, a first water washing tank 30*a* for washing the surface of the substrate with pure water, a blow tank 32 for draining the washed substrate, a second water washing tank 30*b*, and a plating tank 34.

The plating tank 34 includes an overflow tank 36 and a plurality of copper plating units 38 housed inside the overflow tank 36. Each copper plating unit 38 houses the substrate holder 18 holding a substrate inside the copper plating unit 38, and performs a plating process such as copper plating on the substrate. While copper plating will be described in this example, the same plating apparatus 1 can be used for plating with nickel, solder, silver, gold, etc. as well.

The plating apparatus 1 is further equipped with a substrate holder carrier device 40 which carries the substrate holder 18 along with a substrate. For example, the substrate holder carrier device 40 is a linear motor system, and is located on one side of the substrate mounting/dismounting part 20 and the tanks. The substrate holder carrier device 40 has a first transporter 42 which carries a substrate between the substrate mounting/dismounting part 20 and the stocker 24, and a second transporter 44 which carries a substrate among the stocker 24, the pre-wet tank 26, the pre-soak tank 28, the water washing tanks 30*a*, 30*b*, the blow tank 32, and the plating tank 34. However, the substrate holder carrier device 40 may be equipped with only the first transporter 42 without the second transporter 44.

A paddle driving device 46 which drives a paddle (not shown) located inside each copper plating unit 38 and agitating a plating solution is disposed on one side of the overflow tank 36.

Figure 2:
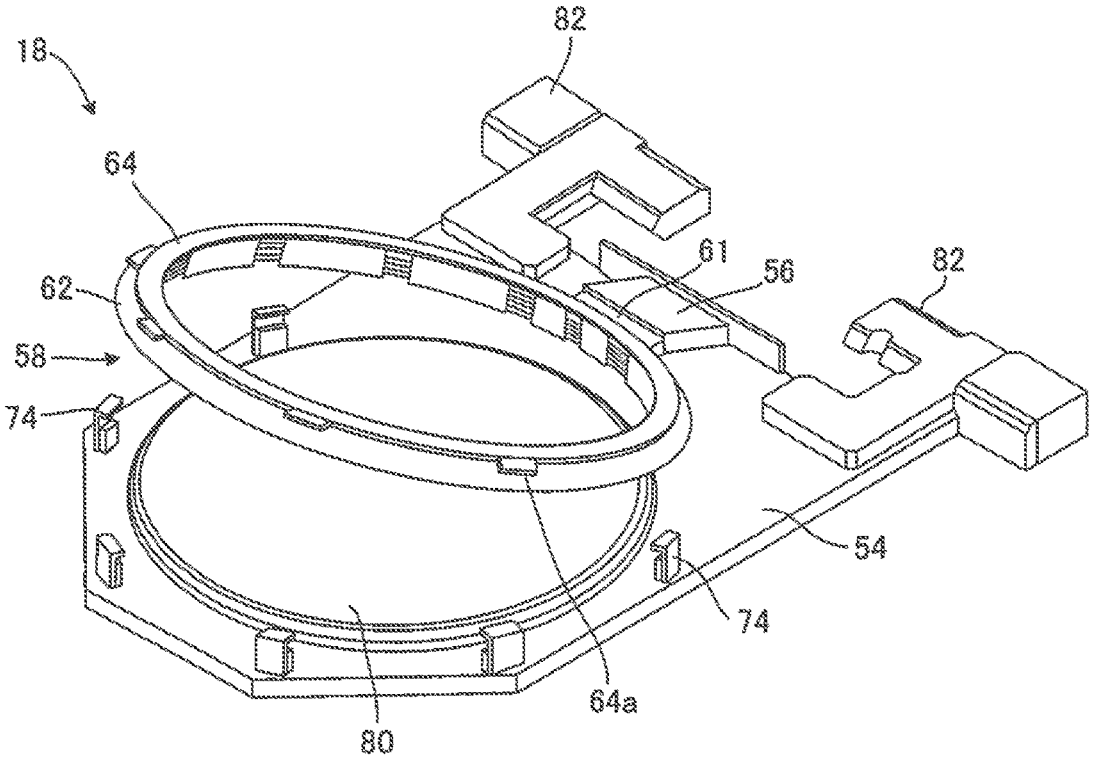
FIG. 2 is a perspective view of the substrate holder according to the embodiment.

FIG. 2 is a perspective view of the substrate holder 18 according to the embodiment used in the plating apparatus 1 shown in FIG. 1. As shown in FIG. 2, the substrate holder 18 has a first holding member 54 which is, for example, made of vinyl chloride and has a rectangular flat plate-like shape, and a second holding member 58 which is mounted through a hinge 56 on this first holding member 54 to be opened or closed. At roughly the center of the first holding member 54 of the substrate holder 18, a holding surface 80 for holding a substrate (corresponding to one example of the substrate holding surface) is provided. On the outside of the holding surface 80 of the first holding member 54, inverted L-shaped clampers 74 having a projecting portion projecting inward are provided at regular intervals along the circumference of the holding surface 80.

A pair of substantially T-shaped hands 82, which serves as a support when the substrate holder 18 is carried or suspended and supported, is coupled at the end of the first holding member 54 of the substrate holder 18. Inside the stocker 24 shown in FIG. 1, the substrate holder 18 is suspended and supported vertically by hanging the hands 82 on the upper surface of the peripheral wall of the stocker 24. This substrate holder 18 suspended and supported is carried by gripping the hands 82 of the substrate holder 18 with the first transporter 42 or the second transporter 44 of the substrate holder carrier device 40. Also inside the pre-wet tank 26, the pre-soak tank 28, the water washing tanks 30*a*, 30*b*, the blow tank 32, and the plating tank 34, the substrate holder 18 is suspended and supported on the peripheral wall through the hands 82.

The hand 82 is provided with external contacts (not shown) to be connected with an external power supply unit. These external contacts are electrically connected through a plurality of wiring lines with a plurality of conductors 88 (see FIG. 3) provided on the outer periphery of the holding surface 80.

The second holding member 58 includes a base part 61 fixed on the hinge 56 and a ring-shaped seal holder 62 fixed on the base part 61. A presser ring 64 for pressing and fixing the seal holder 62 on the first holding member 54 is rotatably mounted on the seal holder 62 of the second holding member 58. The presser ring 64 has a plurality of ridges 64*a* projecting outward from the outer periphery. The upper surface of the ridges 64*a* and the lower surfaces of the inward projecting portions of the clampers 74 have tapered surfaces inclined in opposite directions from each other along a rotation direction.

To hold a substrate, first, the substrate is loaded on the holding surface 80 of the first holding member 54 with the second holding member 58 opened, and the second holding member 58 is closed through the hinge 56. Next, the presser ring 64 is rotated clockwise to slide the ridges 64*a* of the presser ring 64 to the inside (lower side) of the inward projecting portions of the clampers 74. The first holding member 54 and the second holding member 58 are thereby fastened and locked with each other through the tapered surfaces provided in each of the presser ring 64 and the clamper 74, so that the substrate is held. To release the substrate from the holding, the presser ring 64 is rotated counterclockwise with the first holding member 54 and the second holding member 58 locked with each other. The ridges 64*a* of the presser ring 64 are thereby disengaged from the inverted L-shaped clampers 74, so that the substrate is released from the holding.

Figure 3A:
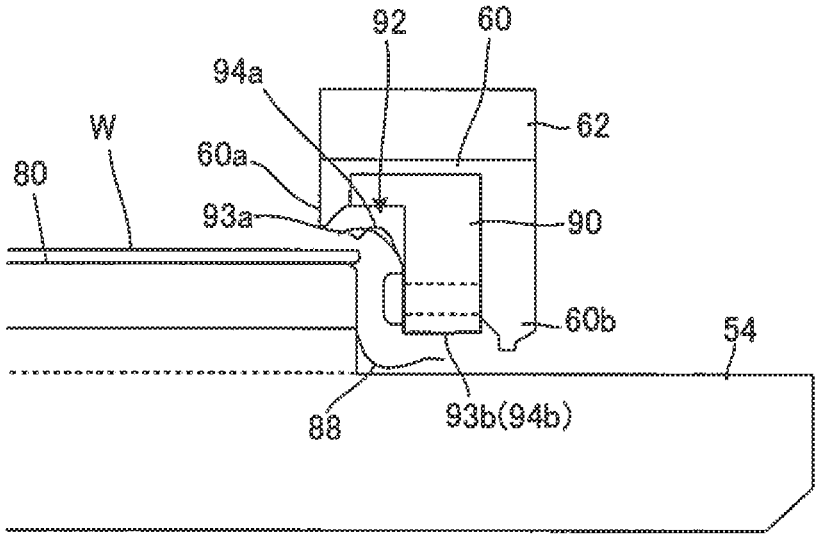
FIG. 3A is a cross-sectional view showing a conductor and an electrical contact of the substrate holder before holding a substrate.
Figure 3B:
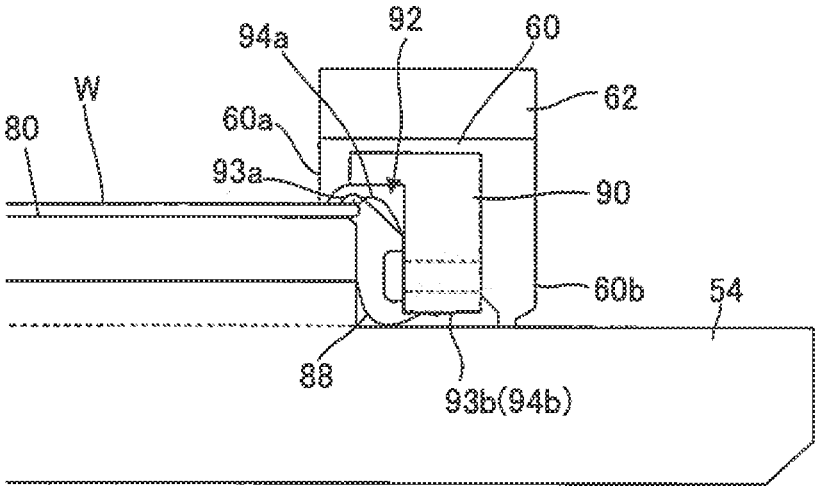
FIG. 3B is a cross-sectional view showing the conductor and the electrical contact of the substrate holder after holding the substrate.

FIG. 3 is a cross-sectional view showing the conductor and the electrical contact of the substrate holder 18 shown in FIG. 2; FIG. 3A shows a state before holding a substrate and FIG. 3B shows a state after holding the substrate. As shown in FIG. 3A, a substrate W is supported on the holding surface 80 of the first holding member 54, and the plurality of conductors 88 (one is shown) which are connected with the plurality of wiring lines extending from the external contacts provided in the hand 82 are disposed between the holding surface 80 and the first holding member 54. The plurality of conductors 88 are disposed on the outside of the circumference of the substrate W so that, when the substrate W is loaded on the holding surface 80 of the first holding member 54, the ends of these conductors 88 are exposed while keeping a spring property on the surface of the first holding member 54 on the side of the substrate W.

A seal member 60, with which the outer periphery of the surface of the substrate W and the first holding member 54 come into pressure contact when the substrate W is held by the substrate holder 18, is mounted on the surface (lower surface in the drawing) of the seal holder 62 facing the first holding member 54. The seal member 60 has a lip portion 60*a* for sealing the surface of the substrate W and a lip portion 60*b* for sealing the surface of the first holding member 54.

A support 90 is mounted on the inside of the seal member 60 between the pair of lip portions 60*a*, 60*b*. A plurality of electrical contacts 92 (power supply members) to which power can be supplied from the conductors 88 are fixed, for example, with a screw on the support 90, and disposed along the circumference of the substrate W.

The electrical contact 92 has a first electrical contact end part 93*a* (corresponding to one example of the first power supply member end part) extending toward the inside of the holding surface 80 and a second electrical contact end part 94*a* (corresponding to one example of the second power supply member end part) extending toward the inside of the holding surface 80. A portion of the first electrical contact end part 93*a* which comes into contact with the substrate is disposed on or above a first position of the holding surface 80. A portion of the second electrical contact end part 93*b* which comes into contact with the substrate is disposed on or above a second position of the holding surface 80. The first position of the holding surface 80 is located on the center side of the holding surface 80 relative to the second position of the holding surface 80. Thus, the first electrical contact end part 93*a* comes into contact with the substrate W at an inner position in the radial direction (corresponding to one example of the first position), while the second electrical contact end part 94*a* comes into contact with the substrate W loaded on the holding surface 80 at an outer position in the radial direction (corresponding to one example of the second position).

The first electrical contact end part 93*a* and the second electrical contact end part 94*a* of this electrical contact 92 are formed to project in the shape of a flat spring in the central direction of the substrate W. The electrical contact 92 has leg portions 93*b*, 94*b*, to which power can be supplied from the conductors 88, at positions (on the lower surface in the drawing) of the support 90 facing the conductors 88.

When the first holding member 54 and the second holding member 58 shown in FIG. 2 are locked with each other, the short lip portion 60*a* on the inner peripheral surface side of the seal member 60 and the longer lip portion 60*b* on the outer peripheral surface side are pressed against the surface of the substrate W and the surface of the first holding member 54, respectively, as shown in FIG. 3B. The gap between the lip portion 60*a* and the lip portion 60*b* is thereby reliably sealed and the substrate W is held.

In a region sealed by the seal member 60, namely, the region between the pair of lip portions 60*a*, 60*b* of the seal member 60, the conductors 88 are electrically connected with the leg portions 93*b*, 94*b* of the electrical contact 92, and at the same time the first electrical contact end part 93*a* and the second electrical contact end part 94*a* come into contact with the substrate W. Thus, it is possible to supply power to the substrate W through the electrical contact 92 while sealing the substrate W with the seal member 60 and holding the substrate W in the substrate holder 18.

Figure 4:
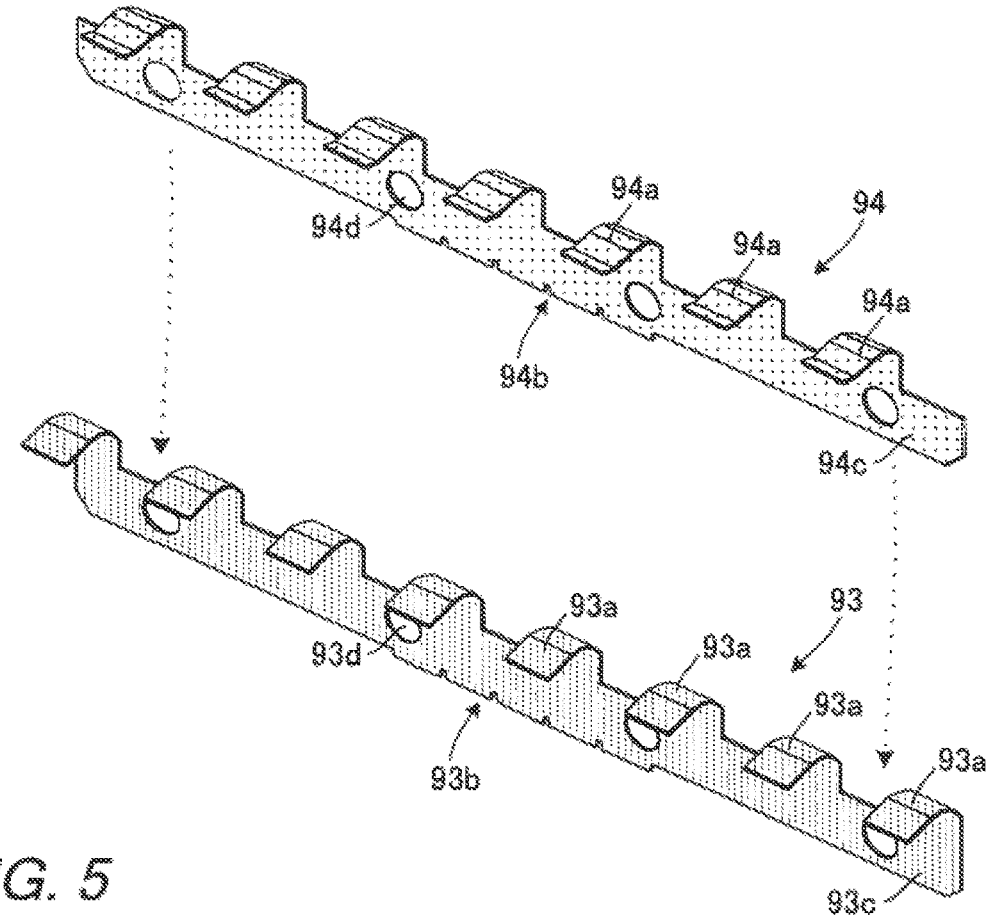
FIG. 4 is an exploded perspective view of the electrical contact.
Figure 5:
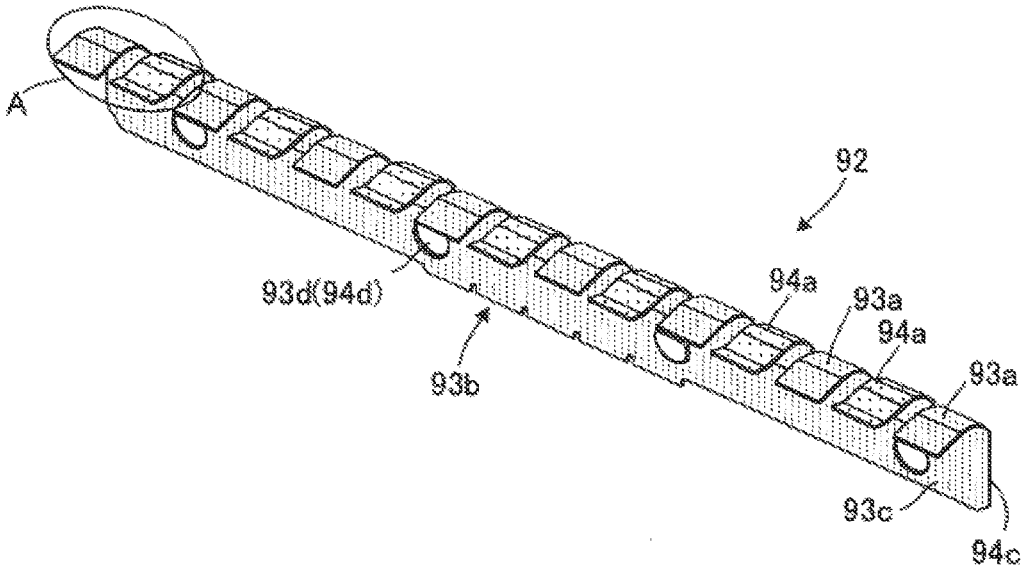
FIG. 5 is a perspective view of the electrical contact.
Figure 6:
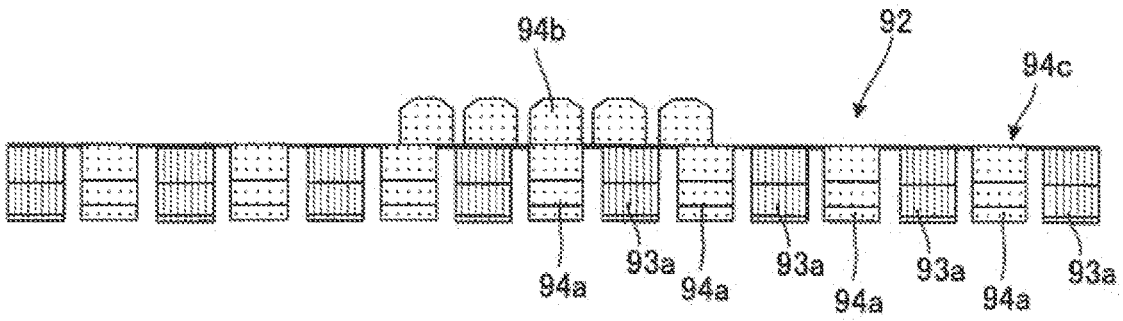
FIG. 6 is a top view of the electrical contact.
Figure 7:
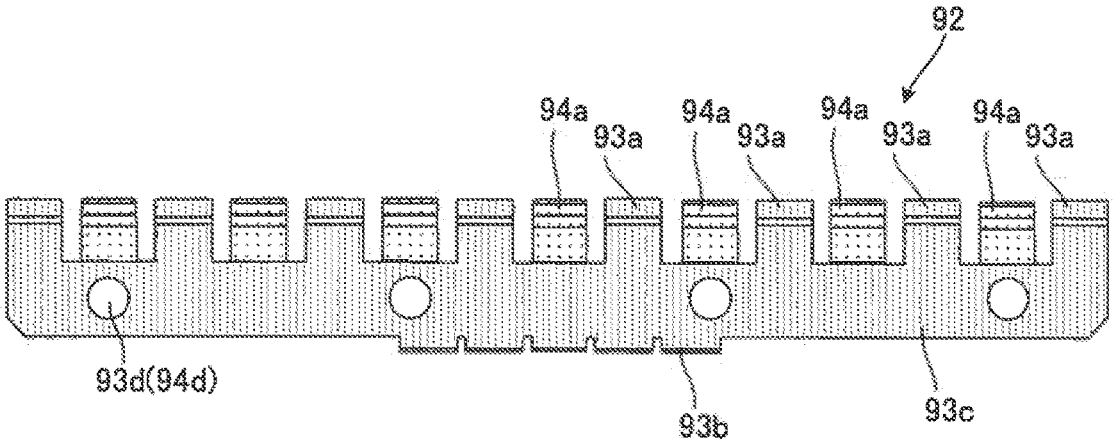
FIG. 7 is a front view of the electrical contact.
Figure 8:
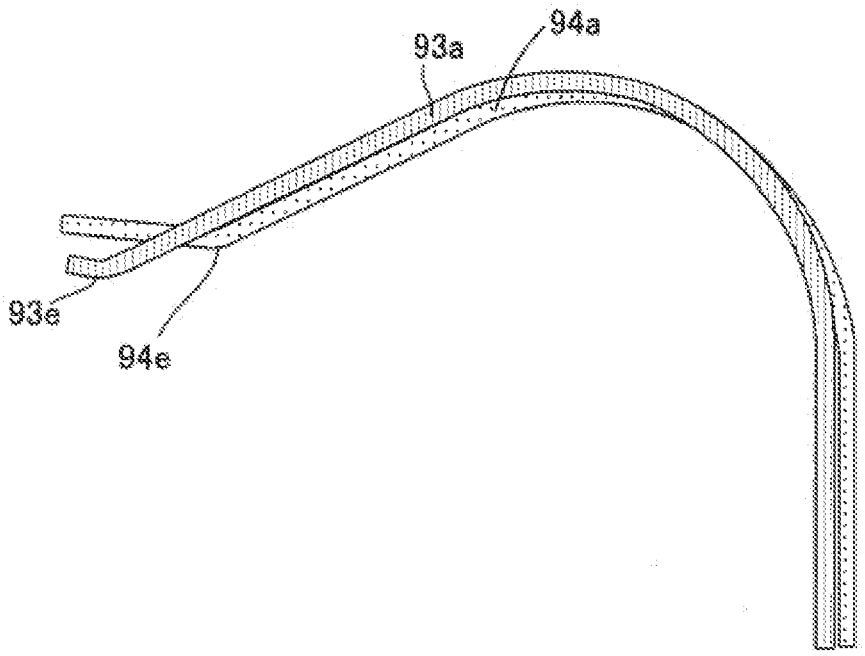
FIG. 8 is an enlarged side view of the part A shown in FIG. 4.

Next, the electrical contact 92 shown in FIG. 3A and FIG. 3B will be described in detail. FIG. 4 is an exploded perspective view of the electrical contact 92, FIG. 5 is a perspective view of the electrical contact 92, FIG. 6 is a top view of the electrical contact 92, FIG. 7 is a front view of the electrical contact 92, and FIG. 8 is an enlarged side view of the part A shown in FIG. 5.

As shown in FIG. 4, the electrical contact 92 has the first electrical contact 93 (corresponding to one example of the first power supply member) and the second electrical contact 94 (corresponding to one example of the second power supply member). The first electrical contact 93 has the plurality of first electrical contact end parts 93*a*, a substantially plate-like first electrical contact body 93*c* for connecting these plurality of first electrical contact end parts 93*a* with one another, and the first leg portion 93*b* which is formed in a lower part of the first electrical contact body 93*c* and electrically connected with the conductors 88 (see FIG. 3A and FIG. 3B).

Similarly, the second electrical contact 94 has the plurality of second electrical contact end parts 94*a*, a substantially plate-like second electrical contact body 94*c* for connecting these second electrical contact end parts 94*a* with one another, and a second leg portion 94*b* which is formed in a lower part of the second electrical contact body 94*c* and electrically connected with the conductors 88 (see FIG. 3A and FIG. 3B).

The plurality of first electrical contact end parts 93*a* are disposed to have a predetermined interval with one another and formed integrally with the first electrical contact body 93*c*. The plurality of second electrical contact end parts 94*a* are disposed to have a predetermined interval with one another and formed integrally with the second electrical contact body 94*c*. The first electrical contact body 93*c* and the second electrical contact body 94*c* are provided with a plurality of holes 93*d*, 94*d* for fixing these electrical contact bodies with screws etc. on the support 90 shown in FIG. 3A and FIG. 3B.

To fix the electrical contact 92 on the support 90 shown in FIG. 3A and FIG. 3B, first, the second electrical contact 94 is placed against the back surface side of the first electrical contact 93 as indicated by the dashed arrows in FIG. 4. In the state where the first electrical contact 93 and the second electrical contact 94 shown in FIG. 5 through FIG. 7 are placed against each other, the electrical contact 92 is fixed on the support 90 shown in FIG. 3A and FIG. 3B. The first electrical contact 93 and the second electrical contact 94 are configured so that, when the first electrical contact body 93*c* and the second electrical contact body 94*c* are placed against each other with the holes 93*d* and the holes 94*d* coinciding with each other, the first electrical contact end parts 93*a* and the second electrical contact end parts 94*a* are disposed alternately. When the electrical contact 92 is fixed on the support 90 shown in FIG. 3, the first electrical contact end parts 93*a* and the second electrical contact end parts 94*a* are disposed adjacent to each other alternately along the circumferential direction of the substrate.

As shown in FIG. 4 through FIG. 8, the first electrical contact end part 93*a* extends from the first electrical contact body 93*c* and is curved substantially at a right angle to the first electrical contact body 93*c*. As shown in FIG. 8, a bent-up portion 93*e* (corresponding to one example of the protruding portion) which is bent up at a predetermined angle is provided at the tip of the first electrical contact end part 93*a*. As will be described later, this bent-up portion 93*e* is a contact part which comes into contact with the substrate W.

Similarly, the second electrical contact end part 94*a* extends from the second electrical contact body 94*c* and is curved substantially at a right angle to the second electrical contact body 94*c*. A bent-up portion 94*e* (corresponding to one example of the protruding portion) which is bent up at a predetermined angle is provided at the tip of the second electrical contact end part 94*a*. As will be described later, this bent-up portion 94*e* is a contact part which comes into contact with the substrate W. Here, the bent-up portion 94*e* of the second electrical contact end part 94*a* is formed closer to the electrical contact body 93*c*, 94*c* than the bent-up portion 93*e* of the first electrical contact end part 93*a*. Accordingly, as has been described with FIGS. 3A and 3B, the first electrical contact end part 93*a* comes into contact with the substrate W at an inner position in the radial direction, while the second electrical contact end part 94*a* comes into contact with the substrate W loaded on the holding surface 80 at an outer position in the radial direction.

In this embodiment, the first electrical contact 93 and the second electrical contact 94 are separable from each other, and therefore the first electrical contact end part 93*a* and the second electrical contact end part 94*a* are separable from each other. That is, the first electrical contact end part 93*a* and the second electrical contact end part 94*a* are configured as separate members. However, the first electrical contact end part 93*a* and the second electrical contact end part 94*a* may be formed integrally by sharing the electrical contact body and the conductors.

Since the electrical contact 92 used for the substrate holder 18 is a consumable, it needs to be replaced after a predetermined period of use. If the first electrical contact end part 93*a* and the second electrical contact end part 94*a* are separable from each other as in this embodiment, when either the first electrical contact end part 93*a* or the second electrical contact end part 94*a* has worn, only the electrical contact that has worn can be replaced. Therefore, the cost can be reduced compared with the case where the first electrical contact end part 93*a* and the second electrical contact end part 94*a* are configured integrally and need to be replaced integrally.

Figure 9:
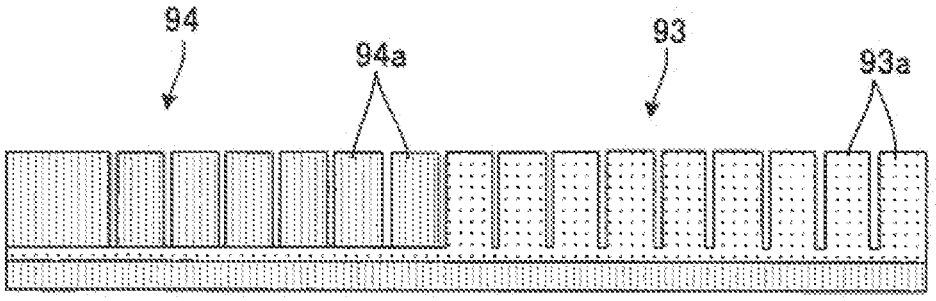
FIG. 9 is a schematic view showing another embodiment of a first electrical contact and a second electrical contact.

FIG. 9 is a schematic view showing another embodiment of the first electrical contact 93 and the second electrical contact 94. The first electrical contact 93 and the second electrical contact 94 shown in FIG. 4 through FIG. 8 are configured so that one first electrical contact end part 93*a* and one second electrical contact end part 94*a* are disposed alternately and adjacent to each other. However, as in the embodiment shown in FIG. 9, a set of first electrical contact end parts 93*a*, formed of a plurality of first electrical contact end parts 93*a* adjacent to one another, and a set of second electrical contact end parts 94*a*, formed of a plurality of second electrical contact end parts 94*a* adjacent to one another, may be disposed adjacent to each other alternately along the circumferential direction of the substrate. Thus, as the first electrical contact end parts 93*a* and the second electrical contact end parts 94*a* are alternately disposed adjacent to each other, it is possible to prevent the first electrical contact end part 93*a* or the second electrical contact end part 94*a* from unevenly coming into contact with the substrate, and to uniformize the distribution of current flowing through the substrate. Therefore, when a substrate is plated using this substrate holder, it is possible to make the thickness and the quality of the film formed on the substrate more uniform.

Although the first electrical contact body 93*c* and the second electrical contact body 94*c* shown in FIG. 4 through FIG. 9 have a flat plate shape, the first electrical contact body 93*c* and the second electrical contact body 94*c* are curved along the circumferential direction of the substrate when mounted on the support 90 shown in FIG. 3A and FIG. 3B. Accordingly, the first electrical contact end parts 93*a* and the second electrical contact end parts 94*a* are disposed along the circumferential direction of the substrate.

Figure 10:
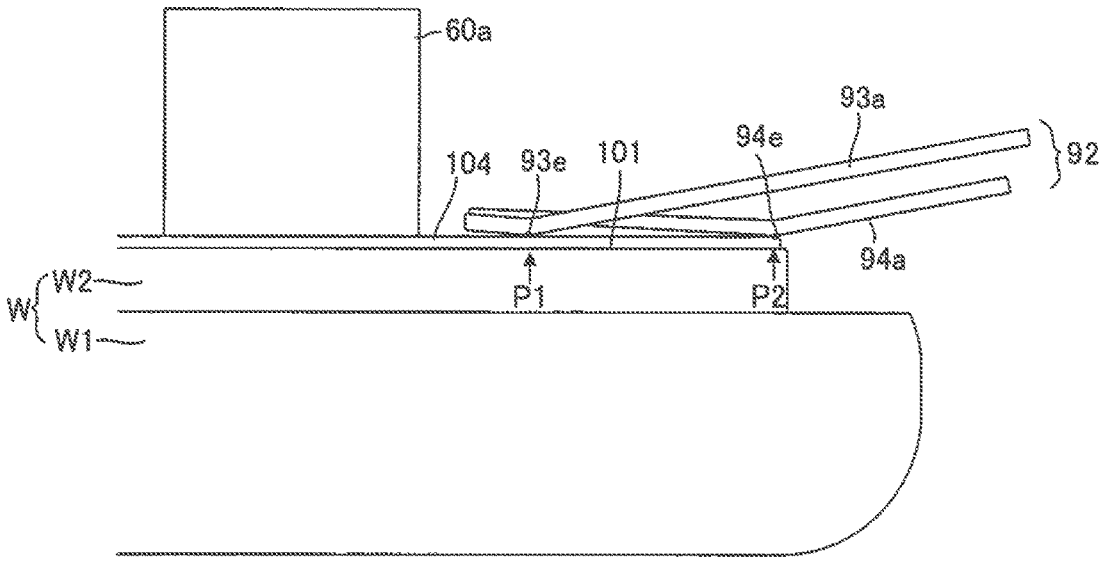
FIG. 10 is a schematic cross-sectional view of a substrate with a TSV formed in it and the electrical contact in contact with this substrate.

FIG. 10 is a schematic cross-sectional view of the substrate W with a TSV formed in it and the electrical contact 92 which comes into contact with this substrate W. In the example shown in FIG. 10, a bonded substrate W composed of a support substrate W1 and an active wafer W2 bonded on the support substrate W1 is the substrate W to be held by the substrate holder 18 according to this embodiment. In this bonded substrate W, for example, a TSV is formed in the active wafer W2, and the surface of the active wafer W2 is the surface to be plated. Therefore, a seed layer 104 being a conductive layer is formed on the surface of the active wafer W2. It is often the case with such a bonded substrate W that due to the manufacturing process the diameter of the active wafer W2 is smaller than the diameter of the support substrate W1, while the support substrate W1 is manufactured in the size of a common substrate.

Here, the first electrical contact end part 93*a* (bent-up portion 93*e*) of the electrical contact 92 comes into contact with the active wafer W2 at a position (first position P1) on a front plane surface portion 101 to supply power to the seed layer 104 of the active wafer W2.

The second electrical contact end part 94*a* (bent-up portion 94*e*) of the electrical contact 92 comes into contact with the active wafer W2 at a position (second position P2) further outside in the radial direction than the first position P1 to supply power to the seed layer 104 of the active wafer W2.

When the first electrical contact end part 93*a* and the second electrical contact end part 94*a* both can supply power to the seed layer 104 of the active wafer W2 as in the example shown in FIG. 10, as the electrical contact 92 comes into contact with the active wafer W2 more evenly along the circumference, the current supply to the seed layer 104 becomes uniform and the in-plane uniformity can be improved.

In the example shown in FIG. 10, not only the first electrical contact end part 93*a* but also the second electrical contact end part 94*a* supplies power to the active wafer W2. However, as long as at least the first electrical contact end part 93*a* can supply power to the active wafer W2, it is not absolutely necessary that the second electrical contact end part 94*a* comes into contact with the seed layer 104 of the active wafer W2. That is, since the first electrical contact end part 93*a* comes into contact with the substrate W at a position further on the inside in the radial direction than the second electrical contact end part 94*a*, even when the second electrical contact end part 94*a* does not come into contact with the seed layer 104 of the active wafer W2, the first electrical contact end part 93*a* can come into contact with the seed layer 104 to supply power to the active wafer W2.

In the case where the second electrical contact end part 94*a* does not come into contact with the seed layer 104 of the active wafer W2, it is desirable that the tip of the second electrical contact end part 94*a* is long enough to be salient to the inside from the outer peripheral end of the active wafer W2. If the tip of the second electrical contact end part 94*a* lies closer to the outer side than the outer peripheral end of the active wafer W2, the tip may catch on the outer peripheral end of the active wafer W2, so that chipping or cracking of the active wafer W2 occurs or the substrate holder 18 cannot be removed with the bonded substrate W held in it.

Figure 11A:
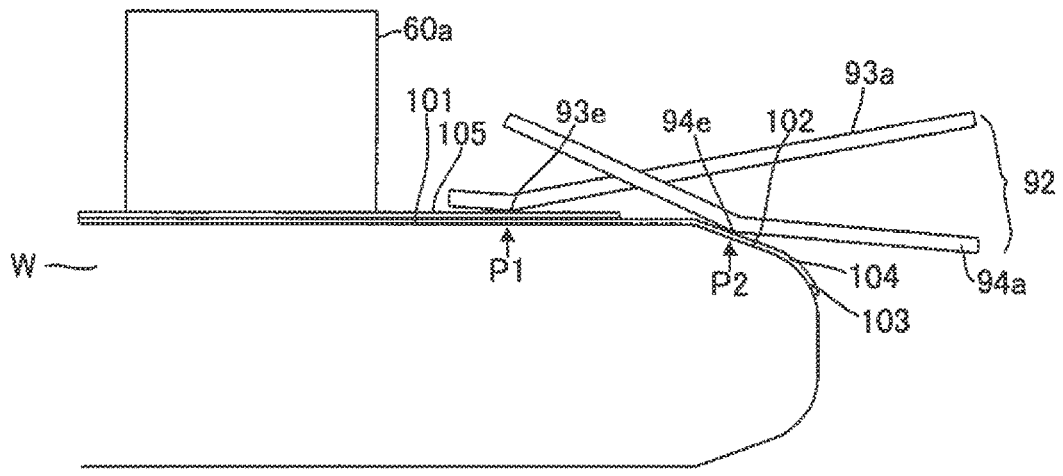
FIG. 11A is a schematic cross-sectional view of a substrate for forming a bump or a rewiring line and an electrical contact in contact with this substrate.

FIG. 11A is a schematic cross-sectional view of the substrate W for forming a bump or a redistribution layer and the electrical contact 92 which comes into contact with this substrate W. In the example shown in FIG. 11A, the substrate W in which a bump or a rewiring line is formed is the substrate to be held by the substrate holder 18 according to this embodiment. This substrate W for forming a bump or a rewiring line has a front plane surface portion 101, a front bevel portion 102, and a front shoulder portion 103. The names of portions of a substrate are based on the definition of SEMI M73-0309.

The substrate W for forming a bump or a rewiring line has the seed layer 104 formed over the front plane surface portion 101, the front bevel portion 102, and the front shoulder portion 103, and a resist 105 is formed on the seed layer 104 of the front plane surface portion 101. The substrate W for forming a bump or a rewiring line refers to a substrate in which an opening is provided in the resist 105 formed on the seed layer 104 and the inside of the opening is plated to form a bump (protruding electrode) or a rewiring line.

Here, the first electrical contact end part 93*a* (bent-up portion 93*e*) of the electrical contact 92 is in contact with the substrate W for forming a bump or a rewiring line at a position (first position P1) on the front plane surface portion 101. Since the resist 105 is formed on the front plane surface portion 101 of the substrate W for forming a bump or a rewiring line, the first electrical contact end part 93*a* does not supply power to the seed layer 104.

On the other hand, the second electrical contact end part 94*a* (bent-up portion 94*e*) of the electrical contact 92 is in contact with the substrate W for forming a bump or a rewiring line at a position (second position P2) on the front bevel portion 102 or the front shoulder portion 103. Since the resist 105 is not formed on the front bevel portion 102 and the front shoulder portion 103 of the substrate W for forming a bump or a rewiring line, the second electrical contact end part 94*a* can supply power to the seed layer 104.

Thus, when the substrate holder 18 holds the substrate W for forming a bump or a rewiring line, the first electrical contact end part 93*a* does not supply power to the substrate W for forming a bump or a rewiring line, while the second electrical contact end part 94*a* can come into contact with the substrate W at the second position P2 on the front bevel portion 102 or the front shoulder portion 103 and supply power.

In FIG. 11A, the bent-up portion 94*e* of the second electrical contact end part 94*a* is in contact with the substrate W at a position on the front bevel portion 102 or the front shoulder portion 103. However, a flat portion other than the bent-up portion 94*e* of the first electrical contact end part 93*a* may come into contact with the front shoulder portion 103, for example. Alternatively, the second electrical contact end part 94*a* may be smoothly curved without having the specific bent-up portion 94*e*.

Figure 11B:
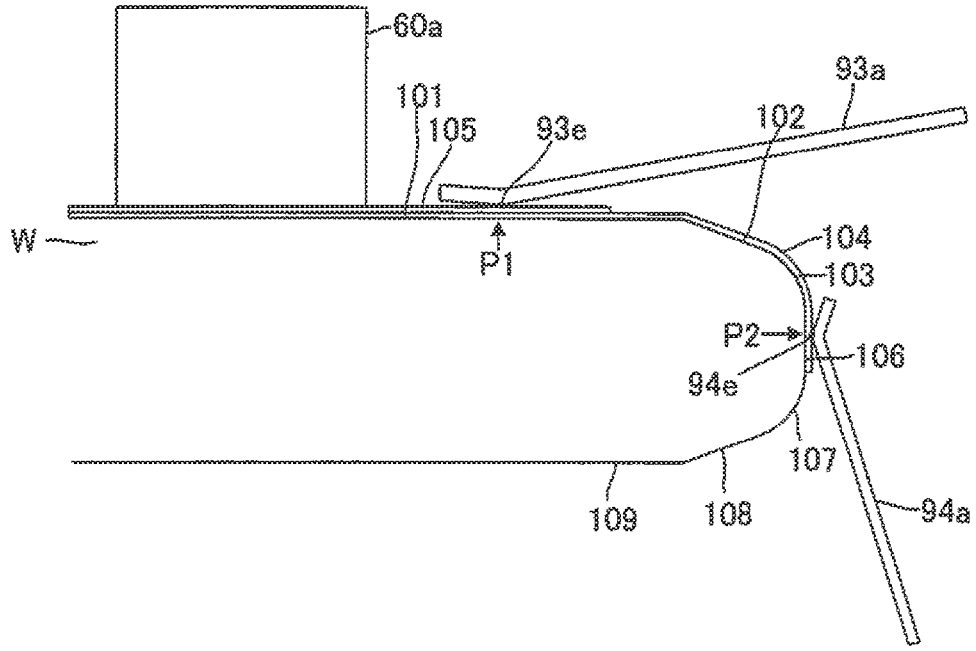
FIG. 11B is a schematic cross-sectional view showing another example of the substrate W for forming a bump or a rewiring line and the electrical contact in contact with this substrate W.
Figure 11C:
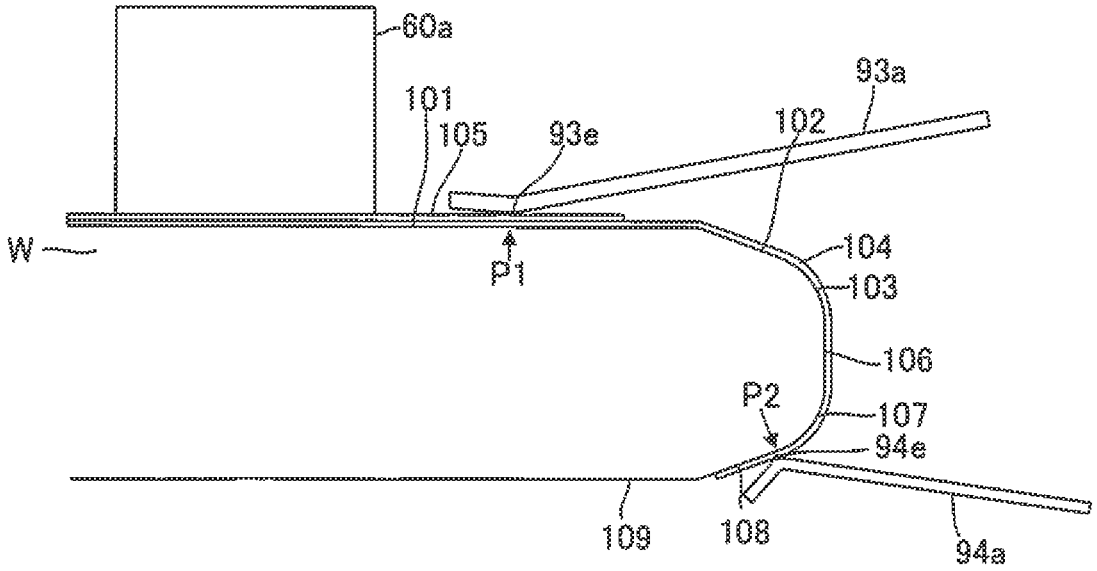
FIG. 11C is a schematic cross-sectional view showing another example of the substrate W for forming a bump or a rewiring line and the electrical contact in contact with this substrate W.

As shown in FIG. 11B, when the seed layer 104 of the substrate W for forming a bump or a rewiring line is also formed in an apex portion 106, the second electrical contact end part 94*a* may come into contact with the substrate W at the second position P2 on the apex portion 106 to supply power. As shown in FIG. 11C, when the seed layer 104 is also formed in a back shoulder portion 107 and a back bevel portion 108 of the substrate W for forming a bump or a rewiring line, the second electrical contact end part 94*a* may come into contact with the substrate W at the second position P2 of the seed layer on the back shoulder portion 107 or the back bevel portion 108 to supply power. Although not shown, when the seed layer 104 is also formed in a back surface portion 109, the second electrical contact end part 94*a* may come into contact with the seed layer on the back surface portion 109 of the substrate to supply power.

As has been described, since the substrate holder 18 according to this embodiment has the first electrical contact end part 93*a*, which can come into contact with the bonded substrate W at the first position P1 on the front plane surface portion 101, and the second electrical contact end part 94*a*, which can come into contact with the substrate W for forming a bump or a rewiring line at the second position P2 on the front bevel portion 102 or the front shoulder portion 103, it is possible to supply power to substrates through at least either the first electrical contact end part 93*a* or the second electrical contact end part 94*a* even when the substrates have different properties.

Here, the different properties of substrates are of course not limited to the difference between the bonded substrate W and the substrate W for forming a bump or a rewiring line. For example, some substrates for forming a bump or a rewiring line have no seed layer formed on the front bevel portion 102 or the front shoulder portion 103, unlike the substrate W for forming a bump or a rewiring line shown in FIG. 11A through FIG. 11C. For such substrates, power is supplied from the seed layer formed on the front plane surface portion 101. That is, there can be different types of substrates even among the substrates for forming a bump or a rewiring line; one type is a substrate to which power is supplied by bringing the contact into contact with the front plane surface portion 101, while the other type is a substrate to which power is supplied by bringing the contact into contact with the front bevel portion 102 or the front shoulder portion 103.

The first position and the second position at which the first power supply member end part and the second power supply end part which allow power to be supplied to substrates having different properties respectively come into contact with the substrate can be selected from different positions of the front plane surface portion, front bevel portion, front shoulder portion, apex portion, back shoulder portion, back bevel portion, and back surface portion.

Since the substrate holder 18 according to this embodiment allows power to be supplied to substrates having different properties such as the bonded substrate W and the substrate W for forming a bump or a rewiring line, it is possible to avoid an increase in the number of substrate holders to be loaded on the plating apparatus and thereby to avoid an increase in installation area of the plating apparatus, while maintaining a desired throughput of the plating apparatus. Since the manipulation for selecting the substrate holder according to the substrate to be processed is not required, the operation of the device is simplified compared with the conventional configuration and the cost of the plating apparatus can be reduced.

In this embodiment, the substrate holder 18 has two types of electrical contact end parts, the first electrical contact end part 93*a* and the second electrical contact end part 94*a*. However, the present invention is not limited to this example, and the substrate holder 18 may has another electrical contact end part which, for example, comes into contact with the substrate at a different position in the radial direction from the first electrical contact end part 93*a* and the second electrical contact end part 94*a*. In that case, it is possible to supply power to a larger number of types of substrates through the substrate holder 18.

Next, an electrical contact according to another embodiment will be described. The electrical contact according to the another embodiment to be described below differs in the shape of the end part from the electrical contact 92 described with FIG. 4 through FIG. 11, and the electrical contact end part of the electrical contact described below can be adopted instead of the first electrical contact end part 93*a* and/or the second electrical contact end part 94*a*.

Figure 12A:
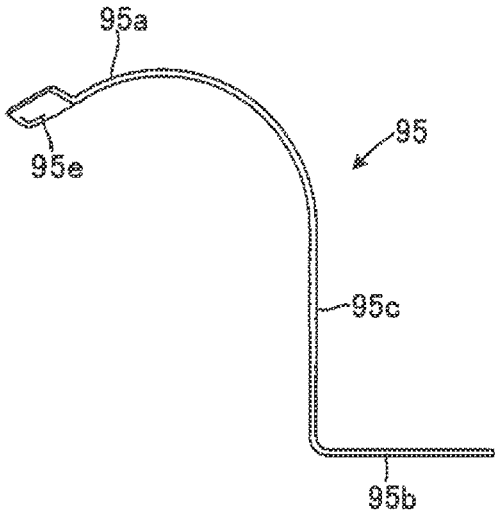
FIG. 12A is a side view of an electrical contact according to another embodiment.
Figure 12B:
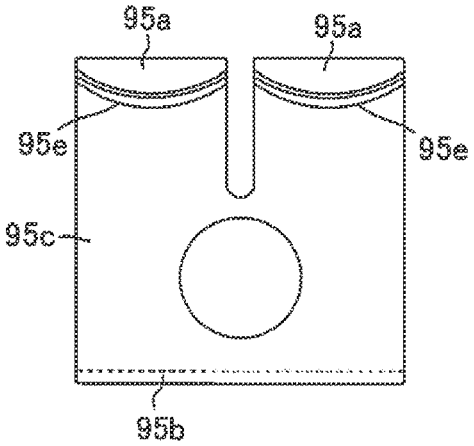
FIG. 12B is a front view of the electrical contact according to the another embodiment.
Figure 12C:
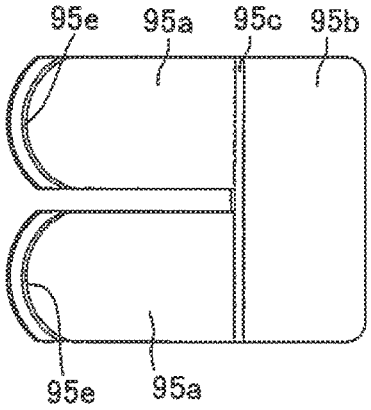
FIG. 12C is a top view of the electrical contact according to the another embodiment.

FIG. 12A is a side view of the electrical contact according to the another embodiment, FIG. 12B is a front view of this electrical contact, and FIG. 12C is a top view of this electrical contact. As shown in the drawings, an electrical contact 95 has an electrical contact end part 95*a*, a substantially plate-like electrical contact body 95*c* formed integrally with the electrical contact end part 95*a*, and a leg portion 95*b* which is formed in a lower part of the electrical contact body 95*c* and comes into contact with the conductor 88 (see FIG. 3).

The electrical contact end part 95*a* of the electrical contact 95 shown in FIG. 12 has a bent-up portion 95*e* (corresponding to one example of the protruding portion) formed by being bent up into a spoon shape at the tip. When power is supplied to a substrate using this electrical contact 95, the lower surface of the bent-up portion 95*e* comes into contact with the front plane surface portion, front bevel portion, or front shoulder portion of the substrate.

Since this electrical contact 95 has the bent-up portion 95*e*, the bottom surface of the bent-up portion 95*e* reliably comes into contact with surfaces of different angles such as the front plane surface portion, front bevel portion, and front shoulder portion, and can supply power stably to the substrate.

Figure 13A:
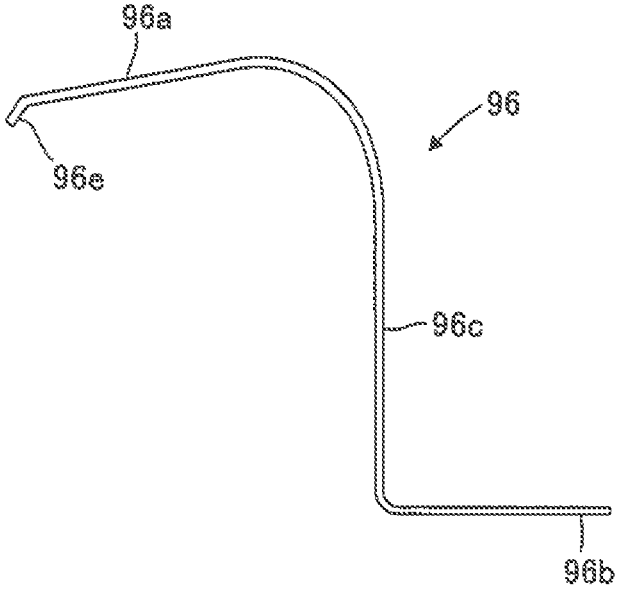
FIG. 13A is a side view of an electrical contact according to another embodiment.
Figure 13B:
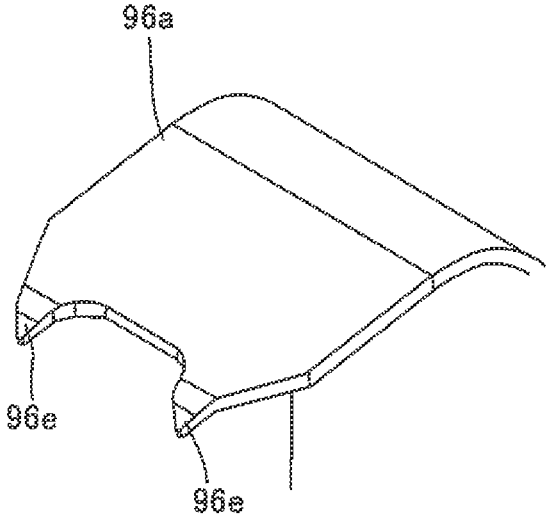
FIG. 13B is a perspective view of an electrical contact end part according to the another embodiment.

FIG. 13A is a side view of the electrical contact according to another embodiment, and FIG. 13B is a perspective view of the electrical contact end part. As shown in FIG. 13A, an electrical contact 96 has an electrical contact end part 96*a*, a substantially plate-like electrical contact body 96*c* formed integrally with the electrical contact end part 96*a*, and a leg portion 96*b* which is formed in a lower part of the electrical contact body 96*c* and comes into contact with the conductor 88 (see FIG. 3).

As shown in FIG. 13B, the electrical contact end part 96*a* has a sharp claw portions 96*e* (corresponding to one example of the protruding portion) at the tip. When power is supplied to a substrate using this electrical contact 96, the claw portions 96*e* come into contact with the front plane surface portion, front bevel portion, or front shoulder portion. Since the electrical contact end part 96*a* has the claw portions 96*e*, the electrical contact 96 can supply power even to a substrate with a resist formed on it as the claw portions 96*e* penetrate the resist.

Figure 14:
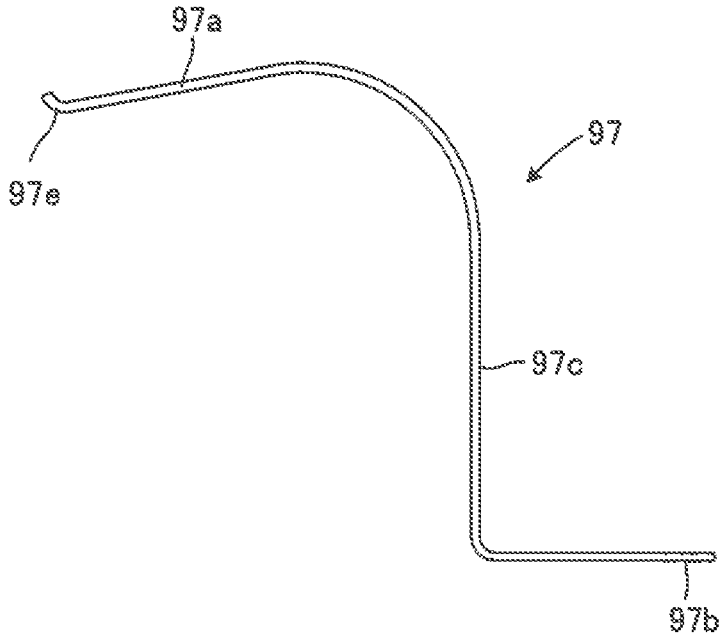
FIG. 14 is a side view of an electrical contact according to another embodiment.

FIG. 14 is a side view of an electrical contact according to another embodiment. As shown in FIG. 14, an electrical contact 97 has an electrical contact end part 97*a*, a substantially plate-like electrical contact body 97*c* formed integrally with the electrical contact end part 97*a*, and a leg portion 97*b* which is formed in a lower part of the electrical contact body 97*c* and comes into contact with the conductor 88 (see FIG. 3).

The electrical contact end part 97*a* of the electrical contact 97 shown in FIG. 14 has a curved portion 97*e* (corresponding to one example of the protruding portion) which is bent up to have a curved lower surface. When power is supplied to a substrate using this electrical contact 97, the lower surface of the curved portion 97*e* comes into contact with the front plane surface portion, front bevel portion, or front shoulder portion of the substrate. According to this electrical contact 97, since the curved portion 97*e* reliably comes into contact with surfaces of different angles such as the front plane surface portion, front bevel portion, and front shoulder portion, power can be supplied stably to the substrate.

Figure 15A:
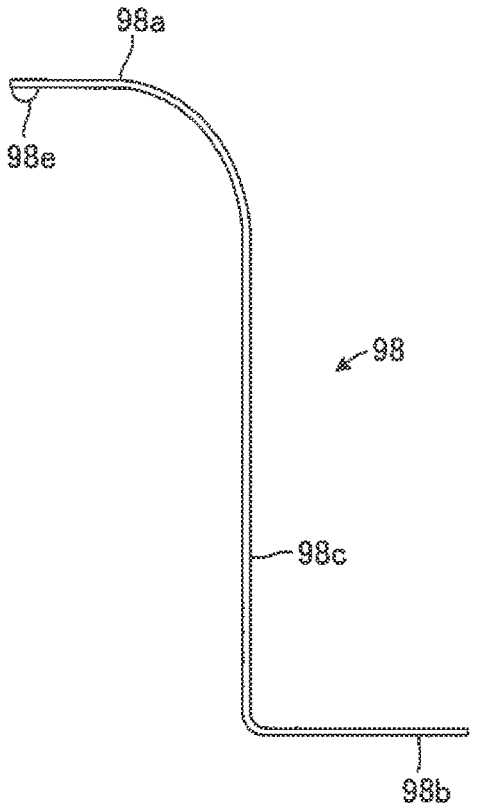
FIG. 15A is a side view of an electrical contact according to another embodiment.
Figure 15B:
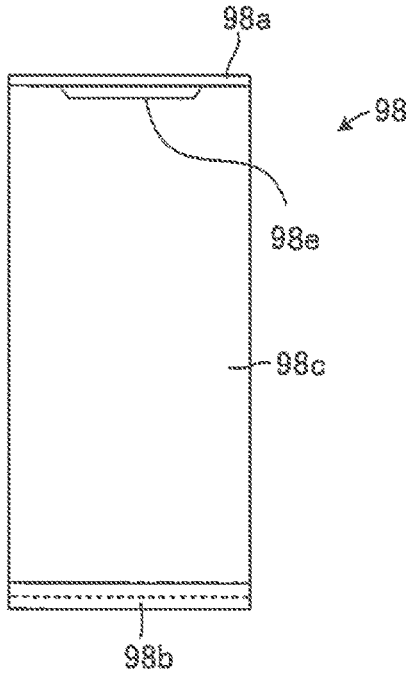
FIG. 15B is a front view of the electrical contact according to the another embodiment.

FIG. 15A is a side view of an electrical contact according to another embodiment, and FIG. 15B is a front view of this electrical contact. As shown in the drawings, an electrical contact 98 has an electrical contact end part 98*a*, a substantially plate-like electrical contact body 98*c* formed integrally with the electrical contact end part 98*a*, and a leg portion 98*b* which is formed in a lower part of the electrical contact body 98*c* and comes into contact with the conductor 88 (see FIG. 3).

The electrical contact end part 98*a* of the electrical contact 98 shown in FIG. 15 has a convex portion 98*e* (corresponding to one example of the protruding portion) formed by embossing. When power is supplied to a substrate using this electrical contact 98, the lower surface of the convex portion 98*e* comes into contact with the front plane surface portion, front bevel portion, or front shoulder portion of the substrate.

According to this electrical contact 98, since the convex portion 98*e* reliably comes into contact with surfaces of different angles such as the front plane surface portion, front bevel portion, and front shoulder portion, power can be supplied stably to the substrate.

Next, a method for plating the substrate W held by the substrate holder 18 having been described above will be described. First, the bonded substrate W or the substrate W for forming a bump or a rewiring line is held by the substrate holder 18. The substrate holder 18 holding the bonded substrate W or the substrate W for forming a bump or a rewiring line is housed in the copper plating unit 38 shown in FIG. 1 and immersed in a plating solution. At this point, the bonded substrate W or the substrate W for forming a bump or a rewiring line is disposed in the plating solution to face an anode, with the surface to be processed of the substrate W and the plane of the anode substantially in parallel to each other. Voltage is applied to the bonded substrate W or the substrate W for forming a bump or a rewiring line and the anode while being immersed in the plating solution. The metal ion contained in the plating solution is thereby reduced on the surface to be processed of the bonded substrate W or the substrate W for forming a bump or a rewiring line, and a film is formed on the surface to be processed.

Here, when the substrate holder 18 holds the bonded substrate W, the first electrical contact end part 93*a* (bent-up portion 93*e*) of the electrical contact 92 comes into contact with the active wafer W2 at the position (first position P1) on the front plane surface portion 101 as shown in FIG. 10, and power is supplied to the seed layer 104 of the active wafer W2. On the other hand, when the substrate holder 18 holds the substrate W for forming a bump or a rewiring line, the second electrical contact end part 94*a* (bent-up portion 94*e*) of the electrical contact 92 comes into contact with the substrate W for forming a bump or a rewiring line at the position (second position P2) on the front bevel portion 102 or the front shoulder portion 103 as shown in FIG. 11, and power is supplied to the seed layer 104. Thus, the substrate holder 18 allows power to be supplied to substrates having different properties for plating.

REFERENCE SIGNS LIST

10 Cassette
12 Cassette table

14 Aligner
16 Spin dryer
18 Substrate holder
20 Substrate mounting/dismounting part
22 Substrate carrier device
24 Stocker
26 Pre-wet tank
28 Pre-soak tank
30*a* First water washing tank
30*b* Second water washing tank
32 Blow tank
34 Plating tank
36 Overflow tank
38 Copper plating unit
40 Substrate holder carrier device
42 First transporter
44 Second transporter
50 Rail
52 Loading plate
54 First holding member
56 Hinge
58 Second holding member
60 Seal member
60*a* Lip portion
60*b* Lip portion
61 Base part
62 Seal holder
64 Presser ring
64*a* Ridge
74 Clamper
80 Holding surface
82 Hand
88 Conductor
90 Support
92 Electrical contact
93*a* First electrical contact end part
93*b* First leg portion
93*c* First electrical contact body
93*d* Hole
93*e* Bent-up portion
94*a* Second electrical contact end part
94*b* Second leg portion
94*c* Second electrical contact body
94*d* Hole
94*e* Bent-up portion
95 Electrical contact
95*a* Electrical contact end part
95*b* Leg portion
95*c* Electrical contact body
95*e* Bent-up portion
96 Electrical contact
96*a* Electrical contact end part
96*b* Leg portion
96*c* Electrical contact body
96*e* Claw portion
97 Electrical contact
97*a* Electrical contact end part
97*b* Leg portion
97*c* Electrical contact body
97*e* Curved portion
98 Electrical contact
98*a* Electrical contact end part
98*b* Leg portion
98*c* Electrical contact body
98*e* Convex portion
101 Front plane surface portion
102 Front bevel portion
103 Front shoulder portion
104 Seed layer
105 Resist
106 Apex portion
107 Back shoulder portion
108 Back bevel portion
109 Back surface portion
P1 First position
P2 Second position
W Substrate
W1 Support substrate
W2 Active wafer

What is claimed is:

1. A substrate holder for holding a substrate, the substrate holder comprising:

a first holding member and a second holding member configured to sandwich the substrate, a substrate holding surface for holding the substrate; and a first power supply member and a second power supply member configured to allow power to be supplied to substrates having different properties, wherein the first power supply member comprises a first power supply body and at least two first power supply member end parts, each of the at least two first power supply member end parts extending from the first power supply body toward the inside of the substrate holding surface and are disposed on or above a first position of the substrate holding surface, the second power supply member comprises a second power supply body and at least two second power supply member end parts, each of the at least two second power supply member end parts extending from the second power supply body toward the inside of the substrate holding surface and disposed on or above a second position of the substrate holding surface, the first position is located on a center side of the substrate holding surface relative to the second position, the first power supply member end part and the second power supply member end part are configured to directly contact with the substrate when the substrate has been held between the first holding member and the second holding member, the first power supply member does not comprise the at least two second power supply member end parts but a plurality of the first power supply member end parts, the second power supply member does not comprise the first power supply member end parts but a plurality of the second power supply member end parts, the plurality of the first power supply member end parts and the plurality of the second power supply member end parts are disposed along the circumferential direction of the substrate, the first power supply member is separable from the second power supply member, such that when the first power supply body is joined with the second power supply body, and the first power supply member end parts and the second power supply member end parts are alternatingly disposed adjacent one another.

2. The substrate holder according to claim 1, wherein the first power supply member end part and/or the second power supply member end part comprises a protruding portion which comes into contact with the substrate.

3. A substrate holder for holding a substrate, the substrate holder comprising: a first holding member and a second holding member configured to sandwich the substrate, and a power supply member comprising a first power supply member and a second power supply member, and configured to contact with the substrate, wherein the first power supply member comprises a first power supply member body and a plurality of first power supply member end parts extending from the first power supply member body, the second power supply member comprises a second power supply member body and a plurality of second power supply member end parts extending from the second power supply member body, the first power supply member body and the second power supply member body configured to be coupled and decoupled from each other so that the first power supply end part interleave each other when the first power supply member body and the second power supply member body are coupled to each other, the plurality of first power supply member end parts comprising a first power supply member end part configured to contact with the substrate at a first position and the plurality of second power supply member end parts comprising a second power supply member end part configured to contact with the substrate at a second position further outside in the radial direction than the first position of the substrate, the first power supply member end part and the second power supply member end part are configured to directly contact with the substrate when the substrate has been held between the first holding member and the second holding member, the plurality of the first power supply member end parts and the plurality of the second power supply member end parts are disposed along the circumferential direction of the substrate.

4. A plating apparatus comprising the substrate holder according to claim 1.

5. The substrate holder according to claim 3, wherein the first power supply member end part and/or the second power supply member end part comprises a protruding portion which comes into contact with the substrate.

6. The substrate holder according to claim 1, wherein the first power supply member end part and/or the second power supply member end part comprises a protruding portion which comes into contact with the substrate.

7. The substrate holder according to claim 4, wherein the first power supply member end part and/or the second power supply member end part comprises a protruding portion which comes into contact with the substrate.

8. A plating apparatus comprising the substrate holder according to claim 3.

9. The substrate holder according to claim 1, wherein the first position is located at a front plane surface portion of the substrate, and the second position is located at a front bevel portion, front shoulder portion, apex portion, back shoulder portion, back bevel portion, or back surface portion of the substrate.

* * * * *